US008315399B2

(12) United States Patent
De Poortere

(10) Patent No.: US 8,315,399 B2
(45) Date of Patent: Nov. 20, 2012

(54) DEVICE FOR AND A METHOD OF PROCESSING AUDIO DATA

(75) Inventor: Gerrit De Poortere, Leuven (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 577 days.

(21) Appl. No.: 12/519,529

(22) PCT Filed: Dec. 13, 2007

(86) PCT No.: PCT/IB2007/055078

§ 371 (c)(1),
(2), (4) Date: Jun. 17, 2009

(87) PCT Pub. No.: WO2008/078227

PCT Pub. Date: Jul. 3, 2008

(65) Prior Publication Data

US 2009/0316912 A1 Dec. 24, 2009

(30) Foreign Application Priority Data

Dec. 21, 2006 (EP) ..... 06126741

(51) Int. Cl.
*H04R 29/00* (2006.01)

(52) U.S. Cl. ..... 381/56; 381/58; 381/98; 381/104

(58) Field of Classification Search ..... 381/1, 59, 381/61, 56–58, 104, 106, 98; 386/308; 84/661
See application file for complete search history.

(56) References Cited

U.S. PATENT DOCUMENTS

| | | | | |
|---|---|---|---|---|
| 4,028,627 | A * | 6/1977 | Cho et al. | 455/214 |
| 4,398,061 | A | 8/1983 | McMann | |
| 5,672,999 | A | 9/1997 | Ferrer et al. | |
| 5,857,056 | A * | 1/1999 | Iwami et al. | 386/308 |
| 5,978,488 | A * | 11/1999 | Margolin | 381/61 |
| 6,111,960 | A | 8/2000 | Aarts et al. | |
| 2005/0120870 | A1 * | 6/2005 | Ludwig | 84/661 |
| 2006/0104451 | A1 * | 5/2006 | Browning et al. | 381/59 |
| 2008/0033695 | A1 | 2/2008 | Sahara et al. | |

FOREIGN PATENT DOCUMENTS

| | | | |
|---|---|---|---|
| JP | 63118194 | A | 5/1988 |
| JP | 11509712 | A | 8/1999 |
| JP | 2002049384 | A | 2/2002 |
| WO | 9742789 | A1 | 11/1997 |
| WO | 2005027569 | A1 | 3/2005 |
| WO | 2005055645 | A1 | 6/2005 |
| WO | 2006043511 | A1 | 4/2006 |

* cited by examiner

*Primary Examiner* — Fan Tsang
*Assistant Examiner* — Eugene Zhao

(57) ABSTRACT

A device (500) for processing audio data (102) comprises an envelope detector (101) for detecting an envelope of the audio data (102) and a frequency generator (103) for generating an oscillation signal (104) oscillating at a predetermined frequency, wherein the frequency generator (103) is coupled to the envelope detector (101) for supplying the envelope detector (101) with the oscillation signal (104), and the envelope detector (101) detects the envelope of the audio data (102) by sampling the audio data (102) based on the oscillation signal (104).

14 Claims, 4 Drawing Sheets

DEVICE FOR AND A METHOD OF PROCESSING AUDIO DATA

FIELD OF THE INVENTION

The invention relates to a device for processing audio data.

Beyond this, the invention relates to a method of processing audio data.

Moreover, the invention relates to a program element.

Furthermore, the invention relates to a computer-readable medium.

BACKGROUND OF THE INVENTION

Audio playback devices become more and more important. Particularly, an increasing number of users buy home-cinema entertainment equipment and other audio surround systems.

In home-cinema movies, very low frequencies are not exceptional. Frequencies of 30 Hz and lower are for instance typical for effects like earthquakes, running dinosaurs, explosions, etc. Audio data in the low frequency range may therefore contribute significantly to the movie experience.

On the other hand, speaker systems designed for low frequency reproduction, for instance a vented subwoofer, may not have the ability to reproduce these low frequencies with sufficient accuracy.

In order to create the "sensation" of perceiving lower frequencies than the loudspeaker can really reproduce, psycho acoustic effects such as the effect of the "missing fundamental" can be exploited. However, algorithms using the principle of the missing fundamental have not yet found their way into home-cinema applications.

BaryBass is an audio concept, which assumes a system with satellites and a subwoofer. A feature of BaryBass is to create a bass impression by projecting the band (or a part of it) that the satellites cannot reproduce to one single frequency. This frequency is amplified and reproduced on a closed loudspeaker box containing a sufficiently high quality loudspeaker. In this way, it may be possible to obtain a high efficient subwoofer. To give an example, with satellites having a cut-off frequency at 120 Hz, ultimately the frequency band between 20 Hz and 120 Hz is projected to one frequency. If that frequency is too low, for instance 50 Hz, the gap between the satellites and the single tone becomes obvious. If the frequency is chosen too high, for instance 70 Hz, the tone becomes noticeably un-harmonic to the rest of the music.

Other systems may work well on full range loudspeakers without the existence of satellites. For instance, a vented system may be provided having a purpose to reproduce a band of frequencies that a subwoofer cannot reproduce as such. A purpose may be not to make a smaller, more efficient subwoofer, but to make more frequencies audible than the subwoofer can physically reproduce. It does not introduce an extra gap between possible satellites and the subwoofer. In a home-cinema application, a subwoofer box may be tuned at a rather low frequency (for instance 50 Hz) where the unharmonicity is less a problem.

Coming back to BaryBass, this technology may project a frequency range to one single constant frequency. It is also possible to project a frequency range to a slightly varying frequency.

WO 2005/027569 A1 discloses a device for producing a driving signal for a transducer, such as a loudspeaker. The driving signal has a frequency substantially equal to a resonance frequency of the transducer and an amplitude controlled by an external signal. The device is arranged for automatically adjusting the frequency of the driving signal to the resonance frequency of the transducer, using a control path. The device may be part of a frequency adaptation device for adapting a frequency range of an audio signal to the transducer.

However, conventional audio systems may suffer from a non-sufficient sound quality, particularly in the bass frequency range.

OBJECT AND SUMMARY OF THE INVENTION

It is an object of the invention to provide an audio system having a sufficient audio playback quality.

In order to achieve the object defined above, a device for processing audio data, a method of processing audio data, a program element and a computer-readable medium according to the independent claims are provided. The dependent claims define advantageous embodiments.

According to an exemplary embodiment of the invention, a device for processing audio data is provided, wherein the device comprises an envelope detector adapted to detect an envelope of the audio data and a frequency generator adapted to generate an oscillation signal oscillating at a predetermined frequency, wherein the frequency generator is coupled to the envelope detector for supplying the envelope detector with the oscillation signal, and wherein the envelope detector is adapted to detect the envelope of the audio data by sampling the audio data based on the oscillation signal.

According to another exemplary embodiment of the invention, a method of processing audio data is provided, wherein the method comprises generating an oscillation signal oscillating at a predetermined frequency, and detecting an envelope of the audio data by sampling the audio data based on the oscillation signal.

According to still another exemplary embodiment of the invention, a program element (e.g. a software routine, in source code or in executable code) is provided, which, when being executed by a processor, is adapted to control or carry out a data processing method having the above mentioned features.

According to yet another exemplary embodiment of the invention, a computer-readable medium (e.g. a CD, a DVD, a USB stick, a floppy disk or a hard disk) is provided, in which a computer program is stored which, when being executed by a processor, is adapted to control or carry out a data processing method having the above mentioned features.

Data processing for audio manipulation or frequency mapping purposes which may be performed according to embodiments of the invention can be realized by a computer program, that is by software, or by using one or more special electronic optimization circuits, that is in hardware, or in hybrid form, that is by means of software components and hardware components.

In the context of this application, the term "envelope detector" may particularly denote an entity or a device used to demodulate alternating (for instance AC) signals. An approximate audio content message may be decoded from the envelope of the modulated signal. In other words, an envelope detector may detect the envelope of a signal to be indicative of the general shape of the signal.

The term "frequency generator" may denote an entity or a device generating an oscillation at a single frequency of, for instance, 50 Hz. Although the generation of a perfect single frequency is not realistic, the actual frequency value of individual sine waves should be very close to a predetermined frequency value.

The term "zero crossing" may denote points of time assigned to phase values of the oscillation signal at which the amplitude is essentially zero. Thus, two subsequent zero crossings equal essentially half a cycle of the oscillation.

The term "bass frequency" may particularly denote an audio bass frequency, that is to say a frequency that is below the mid range and the treble range. Bass frequencies may cover essentially the range below 120 Hz, more particularly a range below 80 Hz.

The term "source signal" may denote an audio content signal, which is provided by an audio source like a hard disk or a CD, or is transmitted via a broadcasting network.

According to an exemplary embodiment of the invention, an audio processing device may be provided having an efficiently operating envelope detector detecting an envelope of an audio data signal between two subsequent zero crossings of an oscillation signal which is used to define a sample interval. Moreover, an output signal generated by the envelope detector may be multiplied with the same oscillation signal used for sampling. This may allow for a proper envelope detection as well as for a proper use of the oscillation signal.

In combination with an upstream and/or a previous low pass filtering of an audio content signal, for isolating an audio bass range, it may be possible to convert this bass range of frequencies being reproducible by many loudspeakers only in a limited way, thereby forming an audio data signal at the frequency of the oscillation signal. This single frequency signal may represent all the very low frequency bass contributions. In other words, the extreme bass signal band may be modulated onto the oscillation signal used as a carrier wave. This may be a very efficient way of mapping particularly bass frequencies onto one single frequency, thereby improving the perceived bass playback quality of an audio reproduction device.

A loudspeaker system has a characteristic high pass behavior. Music components below the system's cut-off frequency may be attenuated or not reproduced at all. Especially in movies, low frequencies play an important role in the creation of the perception experience. In view of this recognition, embodiments of the invention create a sensation of these low frequencies. In contrast to approaches in which features based on the psycho acoustic principle of the missing fundamental are used, exemplary embodiments of the invention are more appropriate for home-cinema systems due to a limited psycho acoustic effect and/or due to audible artifacts of such conventional systems.

According to an exemplary embodiment of the invention, the energy content of an un-reproduced or poorly reproduced low frequency range may be projected on a single frequency that may or may not vary with time. In case of a vented system, this frequency may be around the box tuning frequency. At this frequency, the loudspeaker excursion may be small or minimal, enabling extra mechanical margin for bass enhancement. The ability for human beings to discriminate between low frequencies decreases with the decreasing frequency. In general, the tuning frequency may be rather low (for instance 50 Hz). An extra tone is therefore not perceived as de-attached of the rest of the sound content, thereby improving the perceived sound quality by adding an extra tone representing the energy content of the very low frequency range.

According to an exemplary embodiment of the invention, an audio data processing device may be provided comprising an input for receiving an audio input signal. Furthermore, an envelope detector may be provided and adapted for detecting an envelope of the audio input signal. A frequency generator may be adapted for generating a frequency signal. First detecting means may be provided and adapted to detect zero crossings of the frequency signal. Second detecting means may be adapted to detect amplitude values of the audio input signal. The envelope detector may be designed for adapting the amplitude of the single frequency signal in dependence of a detected amplitude value of the audio input signal at a time between two detected zero crossings of the frequency signal.

By taking such measures, it may be possible to avoid or suppress a booming bass, since the created bass signals follow the time contour of the real bass signal. Less excitation of room modes may be possible. Since the excitation disappears earlier, the room resonances also disappear earlier. Moreover, less dependence of the perceived audio quality on the signal type (for instance pop music, movie, etc.) may be obtained.

In contrast to conventional attack and decay time detectors, an exemplary embodiment of the invention provides a specific detector to overcome artifacts of such attack and decay time detectors. Such conventional detectors introduce a decay time, which may have the consequence that the output signal of the detector does not become immediately zero when the signal drops the zero. As a consequence, a musical bass beat of such conventional systems may get an audible tail, which may be quite annoying.

In contrast to this, according to an exemplary embodiment of the invention, such a detector may look at the absolute maximum between two zero crossings of a trigger signal. That maximum may be routed to the output of the detector. An obtainable benefit is that when a signal drops suddenly, the output of the detector becomes immediately zero so that an audible tail may be suppressed or eliminated.

Exemplary applications of exemplary embodiments of the invention are television devices, home-cinema systems, car stereo systems, or multimedia speakers.

Embodiments of the invention may tackle a problem which may occur in the conventional detection of the energy content in the frequency bands of which the energy has to be calculated: standard level detectors need time to react on the appearance and the disappearance of a signal. The decay of the signal should be followed accurately by the detector. Otherwise an unnatural rumble may occur when the music has disappeared. An envelope detection architecture according to an exemplary embodiment is capable of providing a solution for this problem.

In the following, some recognitions of the inventor will be explained. Based on these and other recognitions, exemplary embodiments of the invention have been developed.

A subwoofer for a consumer home-cinema system is usually a vented box system. At the tuning frequency of the vented box, the excursion of the loudspeaker may be minimal, offering extra mechanical margin for extra electrical bass enhancement. Therefore, a simple bass boost may be tuned to have its center frequency at the tuning frequency of the box. The projection of a lower frequency band to a higher frequency band is possible. For instance, a whole frequency band (for instance 25 Hz to 50 Hz) may be projected to a higher-frequency band via the well-controlled creation of harmonics (for instance 50 Hz to 100 Hz) where the loudspeaker has more mechanical margin. Conventionally, to prevent distortion, the amplitude of the harmonics has to be limited. Also, the higher harmonics do not only create a psycho acoustic perception of a lower pitch. At the same time, they may be perceived as a distortion, which de facto they are.

When projection to a single frequency is used, room modes may become very present. However, exemplary embodiments of the invention may suppress or eliminate the disturbing influence of room modes.

The detection of the low frequency content may be usually done with a standard attack-decay level detector. This type of detector may have a fundamental problem that the decay of the energy does not follow accurately enough the energy decay of the signal. This means that the detector still produces a signal when the music has already died. This may result in the production of a signal, which has no relation to the original music. However, the frequency mapping scheme of exemplary embodiments of the invention using the single frequency oscillation signal as an envelope detector control signal and as a base wave for information modulated on by the envelope may overcome this problem.

Next, further exemplary embodiments of the device will be explained. However, these embodiments also apply to the method, to the program element and to the computer-readable medium.

The envelope detector may be adapted to detect the envelope of a portion of the audio data by determining (an absolute value of) a maximum amplitude of the portion of the audio data between two subsequent zero crossings of the oscillation signal. Such a half wave of the oscillation signal may define a measurement interval for detecting a maximum value of the amplitude. For this purpose, appropriate frequency values of the oscillation signal (for example around 50 Hz) may be appropriate as well, since a corresponding time distance between two subsequent zero-crossings of the oscillation signal may be short enough to accurately resolve the envelope, and may be coarse enough to perform a sufficiently fast signal processing.

The device may comprise a multiplier unit adapted for multiplying the detected envelope signal with the oscillation signal, which has already been used to define a sampling scheme for the envelope detection. Therefore, the output of the multiplier may be a single frequency signal having an amplitude indicative of the amplitude of the deep bass contribution of the audio signal which is conventionally not audible completely by a human ear and/or not reproduced properly by many audio playback devices.

The frequency generator may be adapted to generate an oscillation signal oscillating at a predetermined bass frequency. The term "bass frequency" may denote the lowest audible audio range and may cover particularly the frequency range between essentially 20 Hz and essentially 120 Hz, more particularly a frequency range between essentially 40 Hz and essentially 80 Hz. All these frequency contributions may be mapped to the single frequency of the oscillation signal, thereby generating a single tone which is, in the presence of the mid range and treble signals, perceived by a human listener as a good reflection of the bass regime. Appropriate values of the oscillation signal may be between 50 Hz and 70 Hz, for instance 60 Hz.

The device may comprise a low pass filter adapted for generating the audio signal by performing low pass filtering of a source signal. The source signal may be a signal, which is directly taken from a source of audio data or audio content, such as a hard disk or a CD or DVD, or an audio signal broadcast by a television company. The low pass filter may have a cut-off frequency at a bass frequency, that is to say in a range between 20 Hz and 120 Hz, more particularly in a range between 40 Hz and 80 Hz. The cut-off frequency of the low pass filter may be selected in such a way that the filtering separates frequencies which are well reproduced by an audio reproduction unit such as a loudspeaker and deep bass frequencies which are not or not satisfactorily reproduced by the audio reproduction unit.

The device may further comprise an adder adapted for adding the source signal (comprising all frequency contributions) to a signal output by the multiplier (comprising one frequency signal representing an estimation of very low frequency signals). This allows to add the single frequency bass signal obtained at an output of the multiplier to the initial audio signal, thereby generating a signal, which allows a human listener to hear also an approximation of the bass portion, which is not reproducible, by a loudspeaker with the original signal.

The device may comprise an audio data reproduction unit adapted for reproducing a signal output provided by the adder. Such an audio data reproduction unit may be a loudspeaker, but may also be an earpiece or a headset. Such an audio data reproduction unit may be capable of generating acoustic waves hearable by a human being on the basis of the signal provided at the output of the adder. Thus, the device may comprise an audio reproduction unit for reproducing, inter alia, the frequency mapped audio data to the environment. Such an audio reproduction unit may be one or more loudspeakers, a subwoofer, etc. Therefore, the frequency mapping may be implemented in a complete audio data reproduction system.

The frequency generator may be adapted to generate the oscillation signal oscillating at a predetermined frequency which is constant over time or which varies over time. An oscillation with a constant frequency may be a cheap and simple solution. The possibility to adapt the frequency to the frame conditions, particularly to the hearing capabilities of the human listener or to the kind of audio data to be processed may make the system more flexible to thereby further increase the audible quality.

The envelope detector may comprise a flip-flop having a clock input for receiving a clock signal in the form of the zero crossings of the oscillation signal and may have a data input for receiving a signal being a fingerprint of the audio data to be processed. For example, an amplitude level detector may measure between two zero crossings of an oscillation, the maximum (or an average) of a (low pass filtered) music signal. When the next zero crossing occurs, this value may be clocked in the flip-flop and may be available during the next half period of the oscillator.

The device for processing audio data may be realized as at least one of the group consisting of an audio surround system, a mobile phone, a headset, a loudspeaker, a hearing aid, a television device, a video recorder, a monitor, a gaming device, a laptop, an audio player, a DVD player, a CD player, a hard disk-based media player, an internet radio device, a public entertainment device, an MP3 player, a hi-fi system, a vehicle entertainment device, a car entertainment device, a medical communication system, a body-worn device, a speech communication device, a home cinema system, a home theater system, a flat television, an ambiance creation device, a subwoofer, and a music hall system, or any other electronic device capable of reproducing sound. Other applications are possible as well.

However, although the system according to an embodiment of the invention primarily intends to improve the quality of sound or audio data, it is also possible to apply the system for a combination of audio data and visual data. For instance, an embodiment of the invention may be implemented in audiovisual applications like a video player or a home cinema system in which one or more speakers are used.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
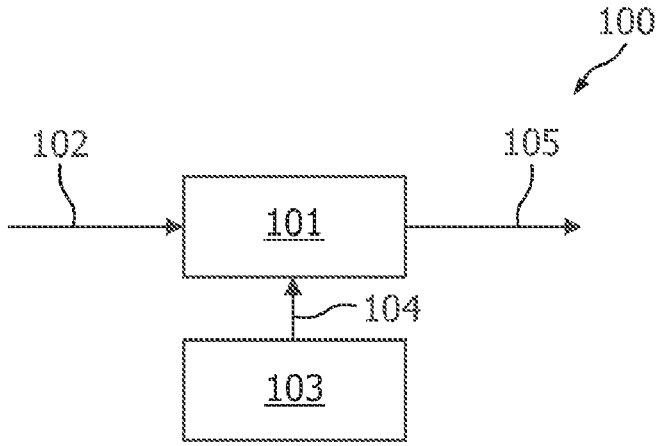
FIG. 1 illustrates an audio data processing device according to an exemplary embodiment of the invention.

The illustration in the drawing is schematically. In different drawings, similar or identical elements are provided with the same reference signs.

In the following, referring to FIG. 1, a device 100 for processing audio data according to an exemplary embodiment of the invention will be explained.

The device 100 comprises an envelope detector 101 adapted to detect an envelope of an audio data input signal 102 provided at a first input of the envelope detector 101.

Furthermore, a frequency generator 103 is provided which is adapted to generate an oscillation signal 104 oscillating at a predetermined frequency. The frequency generator 103 is coupled to a second input of the envelope detector 101 for supplying the envelope detector 101 with the oscillation signal 104.

The envelope detector 101 is adapted to detect the envelope of the audio data input signal 102 by sampling the audio data input signal 102 based on the oscillation signal 104, thereby generating an output signal 105.

As will be explained below in more detail, the envelope detector 101 is adapted to detect the envelope of a portion of the audio data 102 by determining a maximum amplitude of the portion of the audio data 102 between two subsequent zero crossings of the oscillation signal 104.

The frequency generator 103 generates the oscillation signal 104 as a sine wave oscillating at a frequency of 50 Hz.

Figure 2:
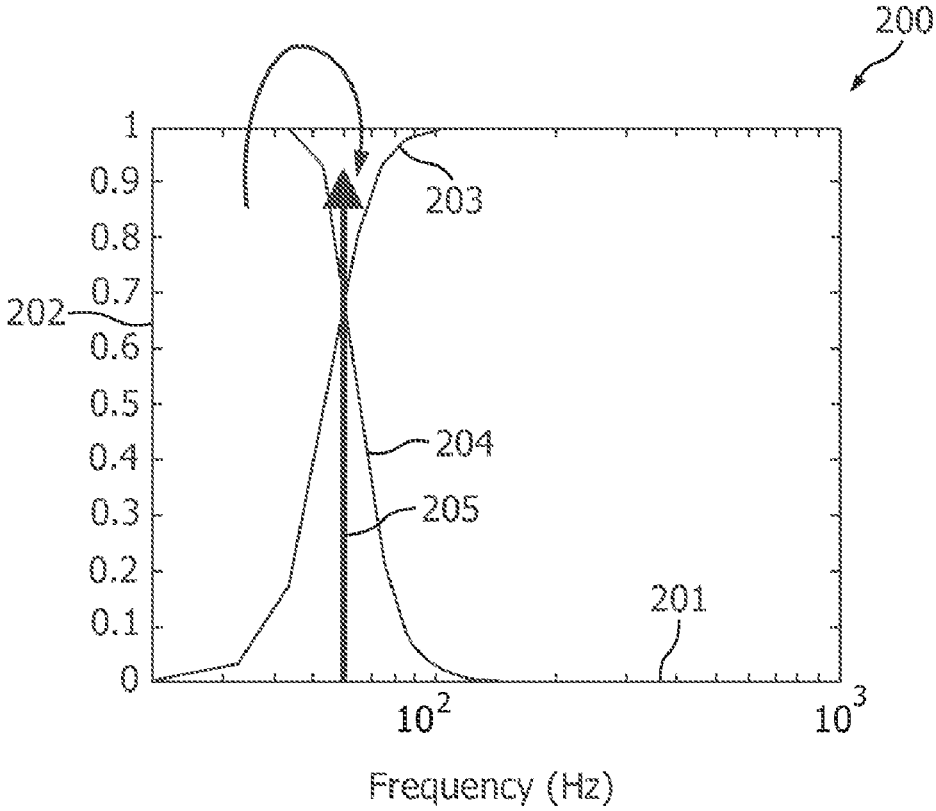
FIG. 2 shows a diagram illustrating a principle of operation of an audio data processing device according to an exemplary embodiment of the invention.

FIG. 2 shows a diagram 200 illustrating an operating principle of an exemplary embodiment of the invention.

Along an abscissa 201 of the diagram 200, the frequency is plotted. Along an ordinate 202 of the diagram 200 a characteristic of a loudspeaker box is plotted.

A first curve 203 represents a loudspeaker box high pass ability to reproduce a frequency spectrum. In the example given, the speaker box has its −3 dB point at 50 Hz. In other words, the first curve 203 is indicative of a reproduced spectrum by a subwoofer.

A second curve 204 of the diagram 200 represents a spectrum in that the box cannot reproduce audio content. In other words, the second curve 204 is indicative of an un-reproduced spectrum of the subwoofer.

The energy (i.e. area) below the second curve 204 is projected on a single frequency 205 represented by an arrow. In other words, the third curve 205 is the projected spectrum reproduced by the subwoofer.

Taking the measures as described, a human listener will hear a modulated single tone at a frequency 205. Since this single tone is not isolated and because it is rather low in frequency, it will be perceived by a human listener essentially as part of the scene.

Provisions may be optionally taken to reduce the disturbing influence of room modes.

One important block is the envelope detector 101.

A standard envelope detector can be described with the following formalism:

u[n]: current input sample of the envelope detector
y[n]: current output value of the envelope detector
y[n−1]: previous output value of the envelope detector
Ta: attack time
Tr: release time
Fs: sampling frequency $$Ka=\exp(-1/(Ta\cdot Fs))$$

$$Kr=\exp(-1/(Tr\cdot Fs))$$

$$Kp=(Kr+Ka)/2$$

$$Km=(Kr-Ka)/2$$

If (|u[n]|>y[n−1])

Then $$Y[n]=y[n-1]\cdot(1-Ka)+|u[n]|\cdot Ka$$

Else $$Y[n]=y[n-1]\cdot(1-Kr).$$

Figure 3:
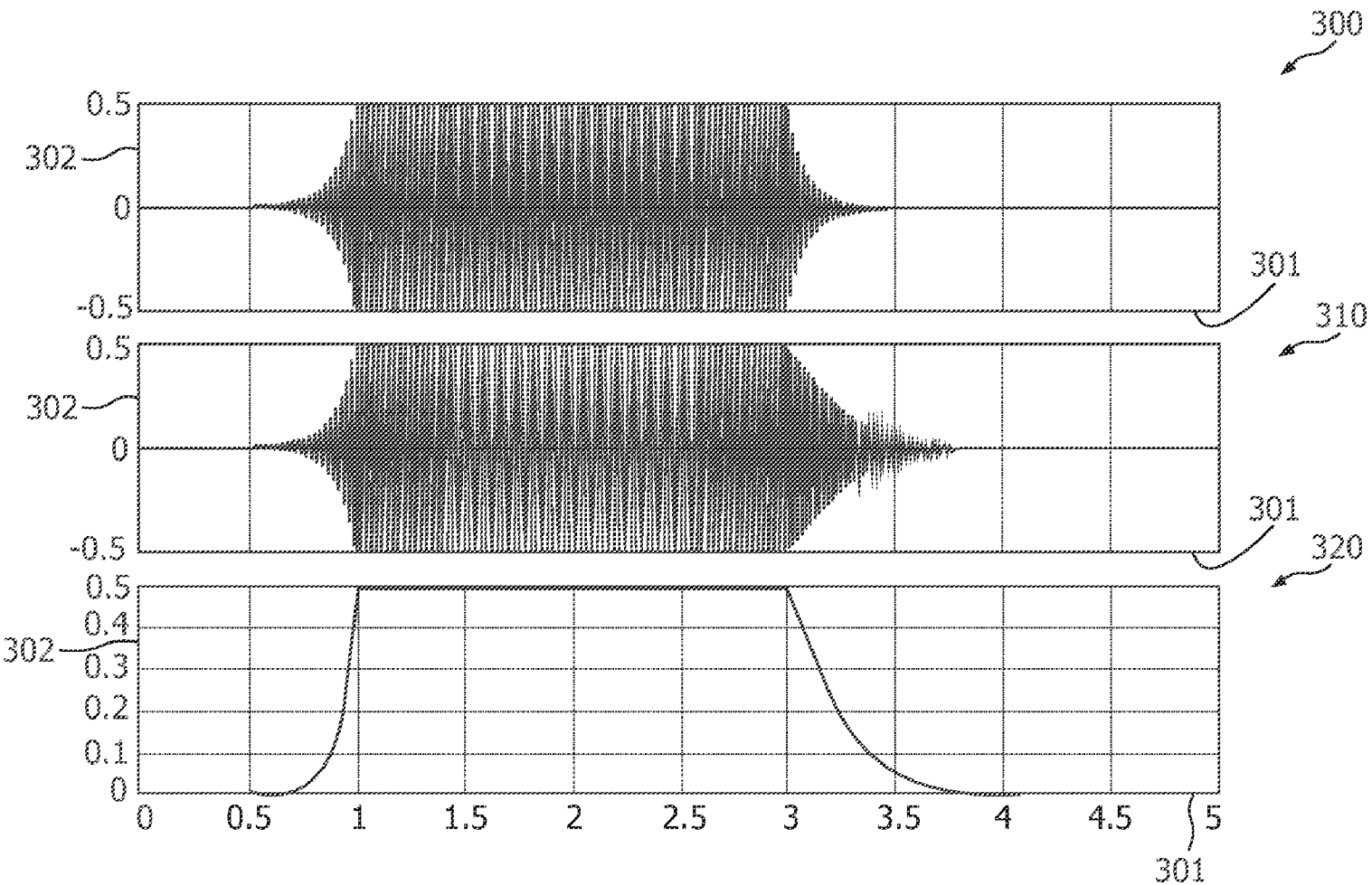
FIG. 3 shows several diagrams illustrating the behavior of an envelope detector according to an exemplary embodiment of the invention.

The oscilloscope picture shown in the diagrams 300, 310 and 320 of FIG. 3 show the typical behavior of such an envelope detector.

Along abscissas 301, the time is plotted in arbitrary units. Along ordinates 302, an amplitude is plotted in arbitrary units.

The diagram 300 shows an input signal 102 of the envelope detector, which is in the present example a 40 Hz sine wave with fade-in and fade-out features.

The second diagram 320 shows the replacement by a fixed 50 Hz sine wave.

The third diagram 310 is an output of the envelope detector with Ta=1 ms, Tr=200 ms.

As can be seen from FIG. 3, the decay time of the envelope detector (diagram 320) is longer than the tail of the original signal (diagram 300). This results in a longer tail in the substituted signal (diagram 310).

This characteristic of a conventional envelope detector may result in an unnatural bass experience. The bass may become boomy. Also room resonances, sensitive to single tone signals are sustained longer and contribute to the unnatural experience. This may be improved by choosing Tr is smaller, but then the output of the envelope detector becomes less constant when the amplitude of the input signal is constant. In its worst form this is experienced as an artificial sound such as a sound of a motorcycle.

Since the original signal is to be substituted by a fixed sine wave at a period T, it may be sufficient to determine the amplitude of that sine wave every half period T/2.

According to an exemplary embodiment of the invention, in a time frame between two zero crossing moments of the substituting signal (T/2), the maximum value of the rectified input signal is determined. This way, the output of the synchronous envelope detector may follow the amplitude of the input signal very well.

Figure 4:
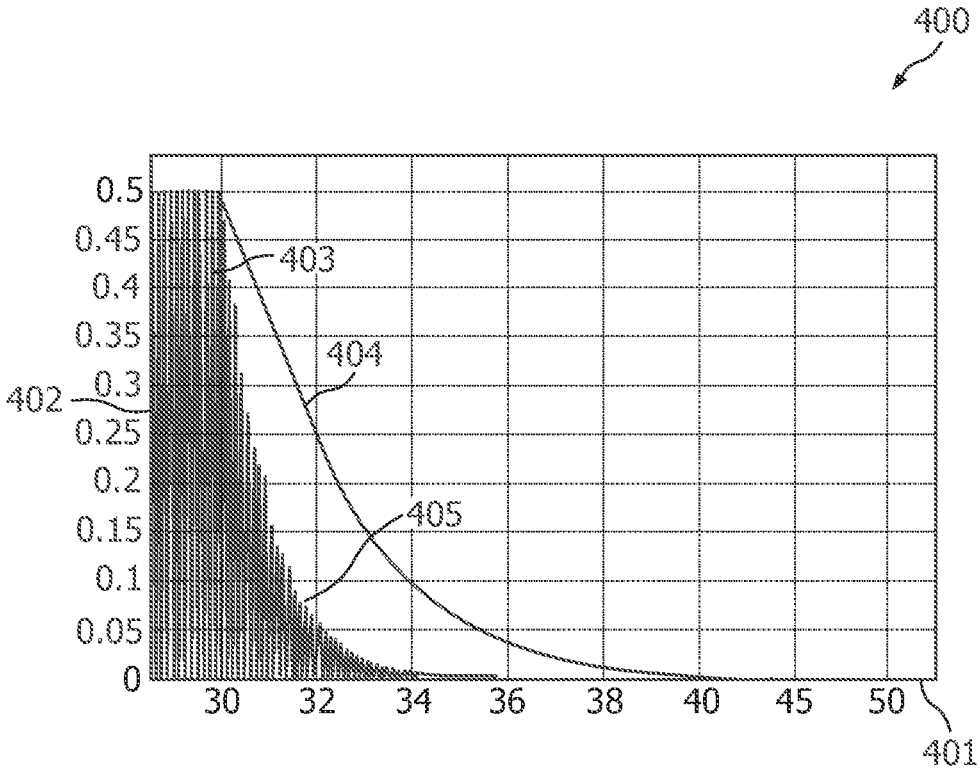
FIG. 4 shows a diagram illustrating the characteristic of different envelope detectors.

FIG. 4 shows a diagram 400 having an abscissa 401 along which the time is plotted. Along an ordinate 402 an amplitude is plotted.

A first graph 403 shows an input signal. A second curve 404 shows a standard detector output. A third curve 405 shows a synchronous detector output as obtained by a configuration of FIG. 1, for instance.

Thus, the configuration of FIG. 1 results in the suppression of a booming bass, in less excitation of room modes and in a reduced dependency of the quality on signal type (that is to say genre of the audio content).

Excitation of voice is less obvious. Sometimes a voice signal can excite the envelope detector. With a longer tail, this may become very unnatural. The synchronous envelope detector 100 may improves this significantly.

In the following, referring to FIG. 5, an audio data processing device 500 according to an exemplary embodiment of the invention will be explained.

Figure 5:
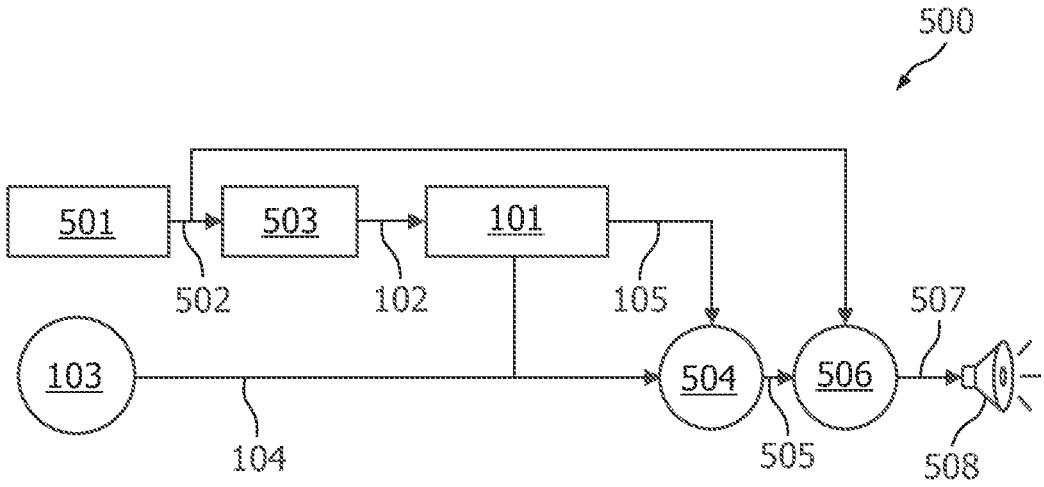
FIG. 5 illustrates an audio data processing system according to an exemplary embodiment of the invention.

FIG. 5 shows a sound source 501 such as a hard disk or a CD player. A source signal 502 is emitted by the sound source 501 and is supplied to a low pass/band pass filter 503 performing a low pass filter function. An output signal 102 of the low pass/band pass filter 503 is supplied as the input signal 102 to the envelope detector 101.

Furthermore, an (time-varying) oscillator 103 supplies the oscillation signal 104 to the synchronous envelope detector 101. At an output of the synchronous envelope detector 101, the output signal 105 is provided which is supplied to a multiplier 504. Furthermore, the multiplier 504 is supplied with the frequency oscillation signal 104. Beyond this, at an output of the multiplier 504, a multiplied signal 505 is provided and supplied to an adder unit 506 for summing the output of the multiplier 504 and the source signal 502. A global output signal or sound output signal 507 is then sent to a loudspeaker 508 for reproduction, i.e. for the generation of acoustic waves. A loudspeaker 508 behaves as a high pass system, reproducing frequencies below its cut-off frequency fc attenuated or even un-audible. Embodiments of the invention may make the listener experience the un-reproduced low frequency band.

Low pass filter 503 passes frequencies below fc to the envelope detector 101. The synchronous level detector 101 outputs an energy envelope 105 of the low frequencies. A sine wave 104 of the time-varying frequency is modulated (multiplied) by this envelope 105 at a multiplier 504 and the result is added to the original signal 502 by the adder unit 506.

Figure 6:
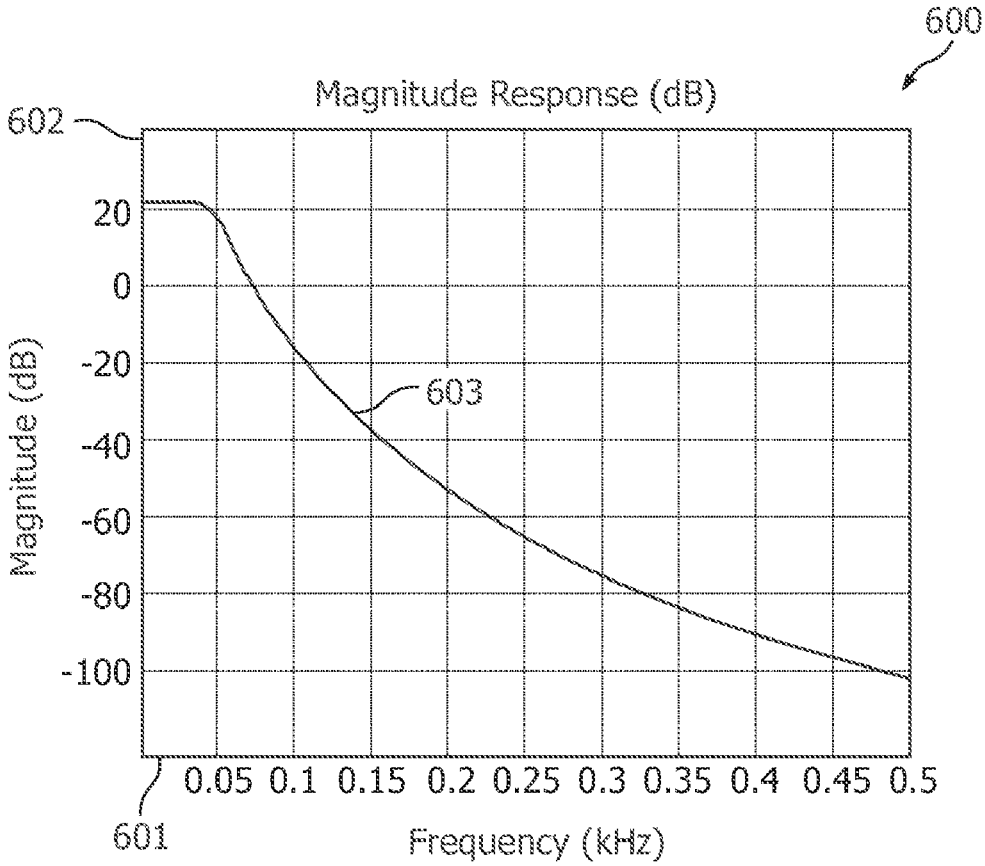
FIG. 6 illustrates a filter characteristic of a low pass filter.

FIG. 6 shows a diagram 600 having an abscissa 601 along which the frequency is plotted. Along an ordinate 602 the magnitude in dB is plotted.

FIG. 6 shows a curve 603 indicative of a low pass filter function. The center frequency of the sine wave is equal to the tuning (Helmholtz) frequency of the subwoofer (assuming it is a vented box). At the Helmholtz frequency, the loudspeaker has a mechanical margin.

Figure 7:
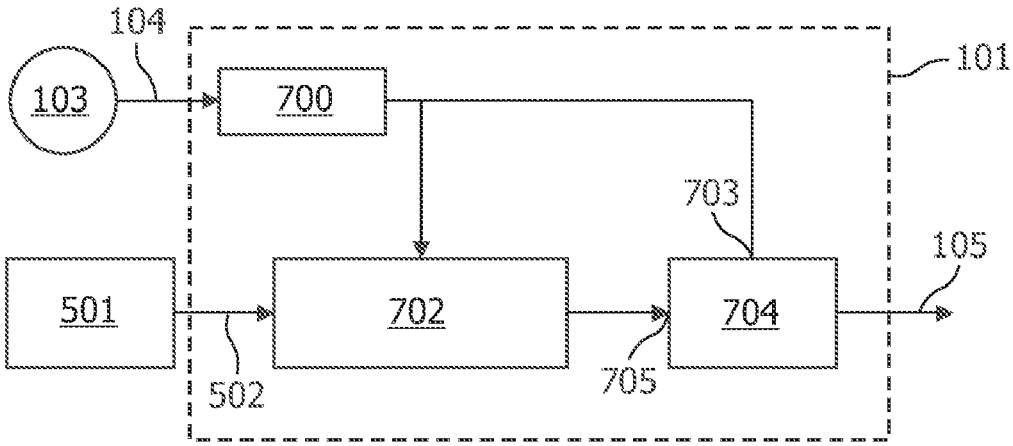
FIG. 7 illustrates a synchronous level detector according to an exemplary embodiment of the invention.

FIG. 7 shows a detail of the synchronous level detector 101.

The oscillation signal 104 generated by the oscillator 103 is supplied to a zero cross detector 700. An output of the zero cross detector 700 is supplied to a running maximum calculator 702, in more detail to a reset input thereof. Furthermore, the output of the zero cross detector 700 is supplied to a clock input 703 of a D flip-flop 704. Furthermore, an output of the running maximum calculator 702 for calculating maximum values within the start and stop times determined by the zero cross detector 700 are supplied to a data input 705 of the D flip-flop 704. An envelope output signal is denoted with reference numeral 105.

The box 101 of FIG. 7 shows an embodiment of the synchronous level detector 101. Between two zero crossings of the sine wave 104, the maximum of the (low pass filter) music signal is measured. When the next zero crossing occurs, this value is clocked in the D flip-flop 704 and is available for the signal during the next half period of the oscillator 103.

Even if this may reproduce a small delay, the improvement over an attack-decay detector is enormous. It is possible to compensate this delay by also delaying the music signals.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope. It should also be noted that reference signs in the claims shall not be construed as limiting the scope of the claims.

The invention claimed is:

1. A device for processing audio data, wherein the device comprises:

an envelope detector adapted to detect an envelope of the audio data;

a frequency generator adapted to generate an oscillation signal oscillating at a predetermined frequency;

wherein an audio data input signal is coupled to a first input of the envelope detector for supplying the envelope detector with the audio data input signal;

wherein a frequency generator output is coupled to a second input of the envelope detector for supplying the envelope detector with the oscillation signal;

wherein the envelope detector is adapted to detect the envelope of the audio data by sampling the audio data and determining a maximum amplitude of the sampled audio data in a portion of the audio data between two subsequent zero crossings of the oscillation signal.

2. The device according to claim 1, comprising a multiplier adapted for multiplying the detected envelope with the oscillation signal.

3. The device according to claim 1, wherein the frequency generator is adapted to generate the oscillation signal oscillating at a predetermined bass frequency in a frequency range between 20 Hz and 120 Hz.

4. The device according to claim 1, wherein the frequency generator is adapted to generate the oscillation signal oscillating at a predetermined bass frequency in a frequency range between 40 Hz and 80 Hz.

5. The device according to claim 2, comprising a low pass filter adaptedfor generating the audio signal by performing low pass filtering of a source signal.

6. The device according to claim 5, wherein the low pass filter has a cut off frequency at a bass frequency in a frequency range between 20 Hz and 120 Hz, more particularly in a frequency range between. 40 Hz and 80 Hz.

7. The device according to claim 5, when referring to claim 3, comprising an adder adapted for adding the source signal and a signal output by the multiplier.

8. The device accordingto claim 7, comprising an audio data reproduction unit adapted for generating acoustic waves based on a signal output by the adder.

9. The device according to claim 1, wherein the frequency generator is adapted to generate the oscillation signal oscillating at a predetermined frequency which is constant over time or which varies over time.

10. The device according to claim 1, wherein the envelope detector comprises a flip-flop having a clock input for receiving a signal indicative of zero crossings of the oscillation signal and having a data input for receiving a signal being characteristic for the audio data.

11. The device according to claim 1, realized as at least one of the group consisting of an audio surround system, a mobile phone, a headset, a loudspeaker, a hearing aid, a television device, a video recorder, a monitor, a gaming device, a laptop, an audio player, a DVD player, a CD player, a based-based media player, an interact radio device, a public entertainment device, an MP3 player, a hi-fi system, a vehicle entertainment device, a car entertainment device, a medical communication system, a body-worn device, a speech communication device, a home cinema system, a home theater system, a television apparatus, an ambiance creation device, a subwoofer, and a music hall system.

12. A method of processing audio data, wherein the method comprises generating an oscillation signal oscillating at a predetermined frequency:

coupling an audio data input signal to a first input of an envelope detector, coupling the oscillation signal to a second input of the envelope detector, detecting an envelope of the audio data by sampling the audio data based on the oscillation signal by determining a maximum amplitude of the sampled audio data in a portion of the audio data between two subsequent zero crossings of the oscillation signal.

13. A non-transitory compute-readable medium, in which a computer program of processing audio data is stored, which computer program, when being executed by a processor, is adapted to carry out or control the method according to claim 12.

14. A program element of processing audio data, which program element, when being executed by a processor, is adapted to carry out or control the method according to claim 12.

* * * * *